US008794469B2

(12) United States Patent
Bratsch

(10) Patent No.: US 8,794,469 B2
(45) Date of Patent: Aug. 5, 2014

(54) CONTAINER LID HAVING A PRESSURE EQUALIZING DEVICE

(75) Inventor: Christian Bratsch, Salzburg (AT)

(73) Assignee: Xolution GmbH, München (DE)

( * ) Notice: Subject to any disclaimer, the term of this patent is extended or adjusted under 35 U.S.C. 154(b) by 0 days.

(21) Appl. No.: 13/138,258

(22) PCT Filed: Sep. 7, 2010

(86) PCT No.: PCT/EP2010/063102

§ 371 (c)(1),
(2), (4) Date: Aug. 11, 2011

(87) PCT Pub. No.: WO2011/026993

PCT Pub. Date: Mar. 10, 2011

(65) Prior Publication Data

US 2012/0145712 A1 Jun. 14, 2012

(30) Foreign Application Priority Data

Sep. 7, 2009 (AT) ..... A 1403/2009

(51) Int. Cl.

| | |
|---|---|
| ***B65D 51/18*** | (2006.01) |
| ***B65D 47/36*** | (2006.01) |
| ***B65D 51/00*** | (2006.01) |
| *B65D 1/12* | (2006.01) |

(52) U.S. Cl.

CPC ..... *B65D 47/36* (2013.01); *B65D 51/007* (2013.01); *B65D 1/12* (2013.01)

USPC ..... 220/254.9; 220/254.1

(58) Field of Classification Search

CPC ..... B65D 47/36; B65D 51/007; B65D 1/12; B65D 2517/0035; B65D 2517/000029; B65D 2517/0011; B65D 2517/0014; B65D 2517/0016; B65D 2517/0038; B65D 2251/00; B65D 2251/02; B65D 2543/00046

USPC ..... 220/254.1, 254.3, 254.9, 254, 256.1, 220/256, 906; 206/216, 217; 426/131, 397

See application file for complete search history.

(56) References Cited

U.S. PATENT DOCUMENTS

| | | | | |
|---|---|---|---|---|
| 4,190,174 | A | 2/1980 | Haimowitz | |
| 4,537,326 | A * | 8/1985 | Morehead | 220/269 |

(Continued)

FOREIGN PATENT DOCUMENTS

| | | |
|---|---|---|
| WO | 0063091 | 10/2000 |
| WO | 2005068313 | 7/2005 |
| WO | 2006009450 | 1/2006 |

*Primary Examiner* — Robert J Hicks
*Assistant Examiner* — Kareen Rush
(74) *Attorney, Agent, or Firm* — Dykema Gossett PLLC

(57) ABSTRACT

The invention relates to a lid (100) of a container, especially a beverage can, comprising a substantially flat lid surface (101) and a preferably folded edge area (102), and at least one pouring opening (103) arranged on the lid surface (101), which pouring opening can be closed in a gas-tight and/or fluid-tight manner by way of at least one closure element (120) arranged in the region of the underside of the lid surface (101) facing the interior of the container, with the closure element (120) being movable from a closed position to an open position by an actuating element (110), and at least one pressure equalizing device is provided which cooperates with the at least one actuating element (110), wherein the at least one pressure equalizing device comprises at least one closing element (112, 113), and at least one pressure equalizing opening (123) is provided which is closeable by means of the at least one closing element (112, 113, 114) when the actuating element (110) is in the closed position and can be exposed entirely upon moving the actuating element (110) from the closed position to the open position, with the exposure of the pressure equalizing opening (123) being reversible.

4 Claims, 14 Drawing Sheets

(56) References Cited

U.S. PATENT DOCUMENTS

| | | | | |
|---|---|---|---|---|
| 4,746,032 | A | 5/1988 | Huang | |
| 5,370,262 | A | 12/1994 | Kato | |
| 5,706,972 | A * | 1/1998 | Sousa | 220/714 |
| 6,279,773 | B1 | 8/2001 | Kiyota | |
| 6,296,137 | B1 * | 10/2001 | Bjørnsen | 220/257.2 |
| 7,198,168 | B2 * | 4/2007 | Mizuma | 220/269 |
| 7,819,280 | B2 | 10/2010 | Perra | |
| 7,918,359 | B2 * | 4/2011 | Paris et al. | 220/254.3 |
| 8,104,319 | B2 * | 1/2012 | Turner et al. | 72/348 |
| D658,980 | S * | 5/2012 | Chapin | D9/434 |
| 2009/0026218 | A1 | 1/2009 | Wong | |

* cited by examiner

CONTAINER LID HAVING A PRESSURE EQUALIZING DEVICE

The invention relates to a lid of a container, especially a beverage can, comprising a substantially flat lid surface and a preferably folded edge area, and at least one pouring opening arranged on the lid surface, which pouring opening can be closed in a gas-tight and/or fluid-tight manner by way of at least one closure element arranged in the region of the underside of the lid surface facing the interior of the container, with the closure element being movable from a closed position to an open position by an actuating element, and at least one pressure equalizing device is provided which cooperates with the at least one actuating element.

Containers, especially beverage cans, are mostly filled with carbonated beverages, wherein the pressure within the beverage can be up to 6 bars. When such pressurized containers are opened by means of a pull tab for example, there will be a sudden drop in pressure within the can, with fluid frequently spraying out of the can. Since this sudden pressure equalization is undesirable due to the likelihood of soiling, devices were developed which should prevent this.

U.S. Pat. No. 5,370,262 A describes a lid for a beverage can, with an auxiliary lid with air holes being provided above an opening lid, which auxiliary lid prevents the content of the can to spray out by the auxiliary lid when opening the beverage can by pressing the opening lid into the can. The auxiliary lid needs to be removed subsequently for emptying the beverage can.

A further possibility to reduce the sudden venting of a beverage can is gradually exposing the opening of the can. Such a procedure with associated lid closure is described in WO 2007/128810 A1. In this case, a base plate is gradually lowered over a cam profile step-by-step during the opening of the can in order to expose the opening of the can.

Moreover, a rotary closure for a foodstuff container is described in EP 1 708 930 B1, comprising a pressure equalizing device which is realized as a pressure equalizing opening in the can closure which is exposed upon opening the can.

EP 1 796 974 B1 discloses a closing apparatus for a beverage container of the kind mentioned above in which a venting device is provided which comprises a pin arranged on a sealing element, which pin is changed in its position during first opening in order to effect the exposure of the pressure equalizing opening. This pressure equalizing opening is not sealed or only inadequately sealed during the renewed closure of the container, so that the content of the container can escape.

The solutions described in the state of the art either offer only limited protection against outward spurting of the content of the can or are extremely complicated and are therefore arranged to be very expensive.

It is therefore the object of the invention to eliminate the aforementioned disadvantages of the state of the art and to provide a lid for a container which enables secure venting during the opening of the container.

This object is achieved in accordance with the invention by a lid of the kind mentioned above in such a way that the at least one pressure equalizing device comprises at least one closing element, and at least one pressure equalizing opening is provided which is closeable by means of the at least one closing element when the actuating element is in the closed position and can be exposed entirely upon moving the actuating element from the closed position to the open position, with the exposure of the pressure equalizing opening being reversible. A closing element is provided in the present invention which seals a pressure equalizing opening penetrating the lid for example when the closure means is in the closed position. When moving the actuating element from the closed position, the at least one pressure equalizing opening is exposed. When closing the container by moving the actuating element and therefore the closing element, the pressure equalizing opening is sealed again in a gas-tight and fluid-tight manner.

Preferably, the closing element is arranged as a pin which can be moved entirely out of the at least one pressure equalizing opening upon movement of the actuating element from the closed position to the open position and seals the at least one pressure equalizing opening in the closed position of the actuating element.

An especially simple configuration of the lid in accordance with the invention is obtained when the at least one closing element is integrally arranged with the at least one actuating element.

It is provided as an alternative thereto in a further embodiment of the invention that the closing element cooperates with a tube made of flexible material which is in connection with the at least one pressure equalizing opening, wherein the tube is sealed in a gas-tight manner by way of a reversible cross-sectional constriction when the at least one actuating element is in the closed position. In this variant, the tubular or trunk-like closing element is bent off by the movement of the actuating element from the open position to the closed position, thus producing a cross-sectional constriction within the tube and sealing the pressure equalizing opening in a gas-tight and fluid-tight manner.

Preferably, the at least one actuating element simultaneously acts as a closing element for the pressure equalizing device, with the at least one closure means having a shaped portion made of a flexible material in an especially preferable way which seals the at least one pressure equalizing opening in a gas-tight manner when the actuating element is in the closed position.

The pressure equalizing device as described above in the lid in accordance with the invention is especially suitable for closure means which are displaceable substantially linearly and parallel to the lid. Similarly, it can be used for closure means which are twistable in relation to the surface of the lid, with the twisting of the actuating element preferably occurring along a helix element and the at least one pressure equalizing opening being arranged within the helix element for example.

It is preferably also provided that the at least one closure means is swivellable in a substantially perpendicular way with respect to the lid in order to open the at least one pouring opening or to reseal the same again.

The actuating element can be fixed in the closed position in a further embodiment of the invention. Inadvertent opening of the beverage can is thereby prevented.

Preferably, the fixing of the actuating element occurs by way of a fixing element with a handle which is swivellable from a plane arranged substantially parallel to the surface of the lid and conventionally arranged in the plane of the actuating element, with the fixing element being connected in an articulated and non-detachable way with the actuating element. The actuating element is released by swiveling the fixing element and can optionally be displaced.

In order to obtain a tamper-proof closure, it is preferably provided in accordance with the invention that the handle is in connection by way of at least one predetermined breaking point with at least one connecting element arranged on the surface of the lid prior to the first pivoting for releasing the actuating element. The at least one predetermined breaking point is broken open by pivoting the handle and the actuating element is released.

It is provided in an especially preferred embodiment that the closing element is arranged on the fixing element for the at least one pressure equalizing opening. When the handle or the fixing element is pivoted, there is pressure equalization first by opening the pressure equalizing opening and only subsequently will the actuating element be released for exposing the pouring opening.

It has been seen that the operation of the handle is substantially simplified when it is arranged in a Y-like or T-like manner. As a result of the shape, a strong force is exerted first on the at least one predetermined breaking point in order to open the same at first and in order to subsequently cause an exposure of the actuating element with lower force.

It is provided in an especially preferred way that the closure element and the pressure equalizing opening have a common, preferably integral, seal. In this way, an especially gas-tight and fluid-tight and re-closable lid for a beverage can is obtained.

It is provided in accordance with the invention that upon movement of the actuating element from a closed position to an open position the at least one closing element will expose at first the at least one pressure equalizing opening before the closure means subsequently exposes the pouring opening. Lower forces for exposing a pouring opening are required for opening the pouring opening after venting of the container, especially in the case of pressurized containers.

The invention will be explained below in closer detail by reference to non-limiting embodiments shown in the drawings, wherein:

FIG. 1*a* to FIG. 1*e* shows a first embodiment of the invention;

Figure 6:
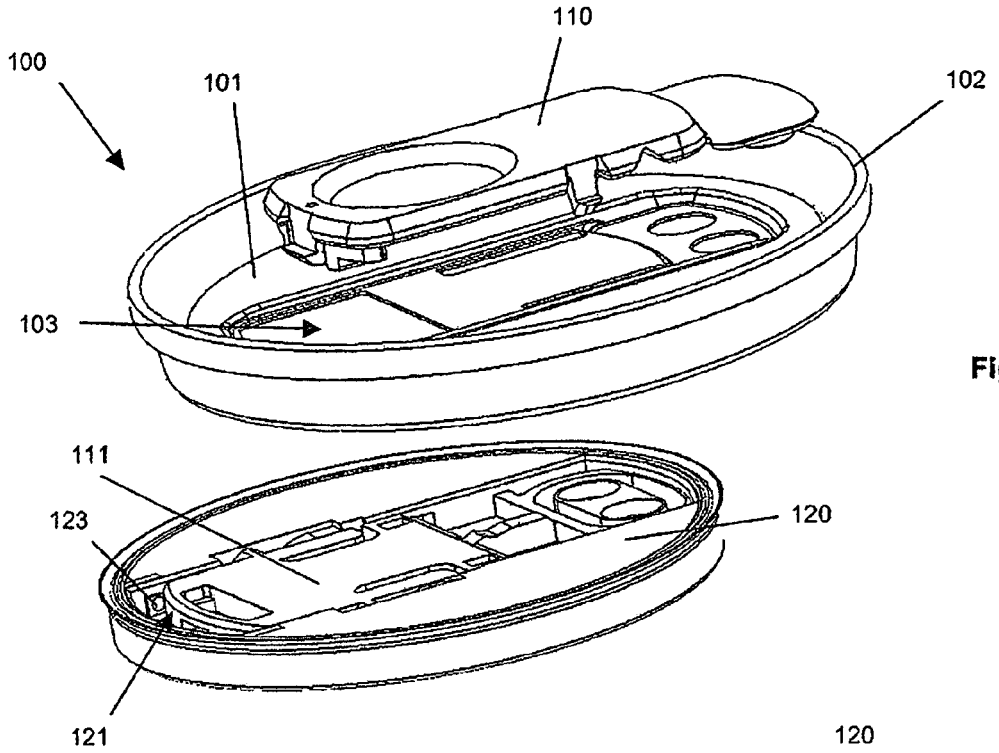
Figure 7:
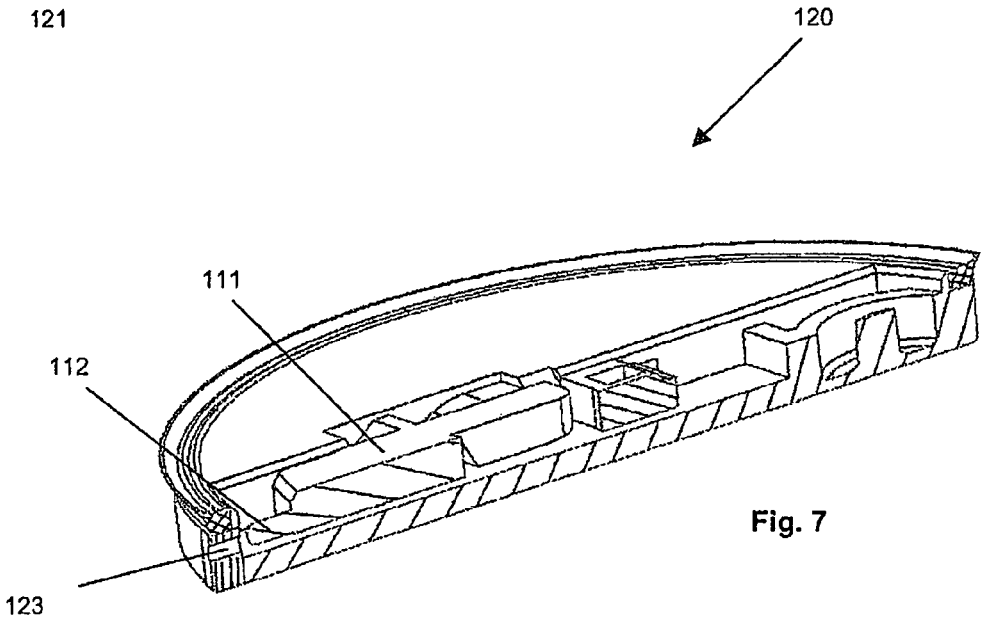
Figure 8:
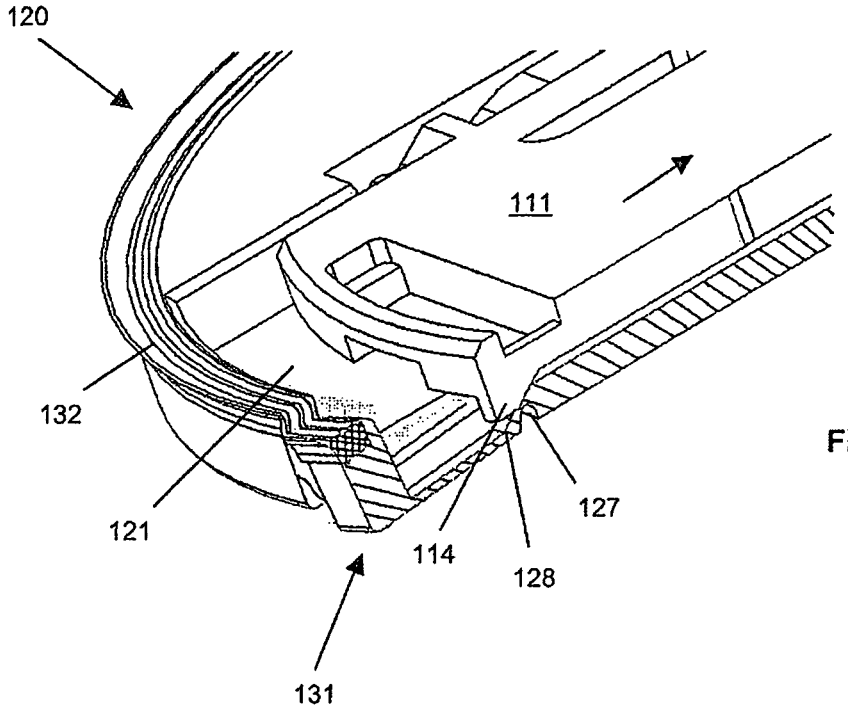

FIGS. 4*a* to 4*g* show a fourth embodiment of the invention;

FIGS. 5*a* to 5*e* show a fifth embodiment of the invention;

FIG. 6 shows a sixth embodiment of the invention;

FIG. 7 shows a seventh embodiment of the invention;

FIG. 8 shows an eighth embodiment of the invention, and

FIGS. 9 to 14 show a ninth embodiment of the invention.

FIGS. 1*a* to 1*e* show a lid 100 with a lid surface 101 and a beaded edge 102, as can be found in beverage cans for example. The lid 100 comprises a pouring opening 103 which is sealed by a closure means 110, which in this case is a sliding element. The lid surface 101 further comprises an operating opening 104 in which an operating element 111 of the sliding element will engage.

Figure 1A:
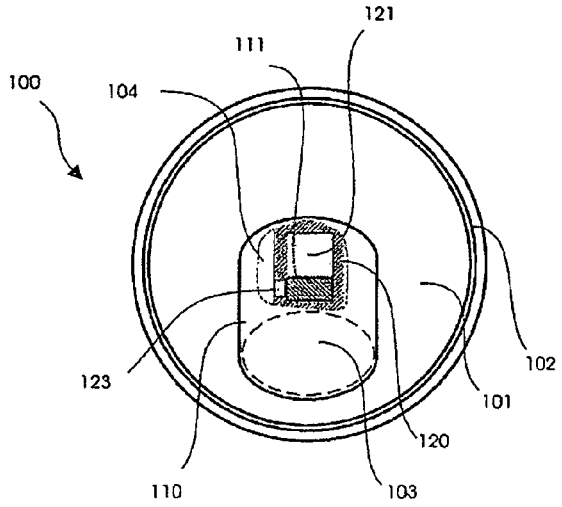
Figure 1B:
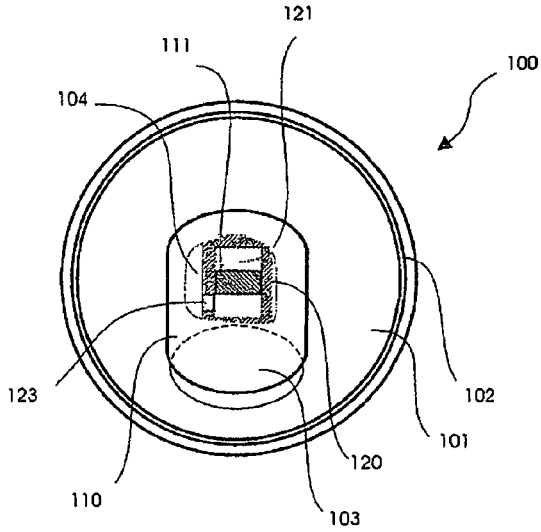
Figure 1C:
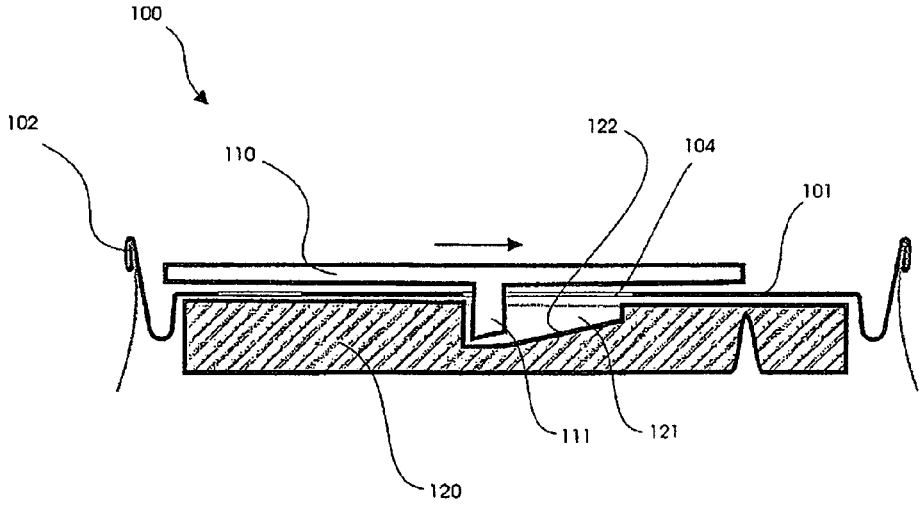
Figure 1D:
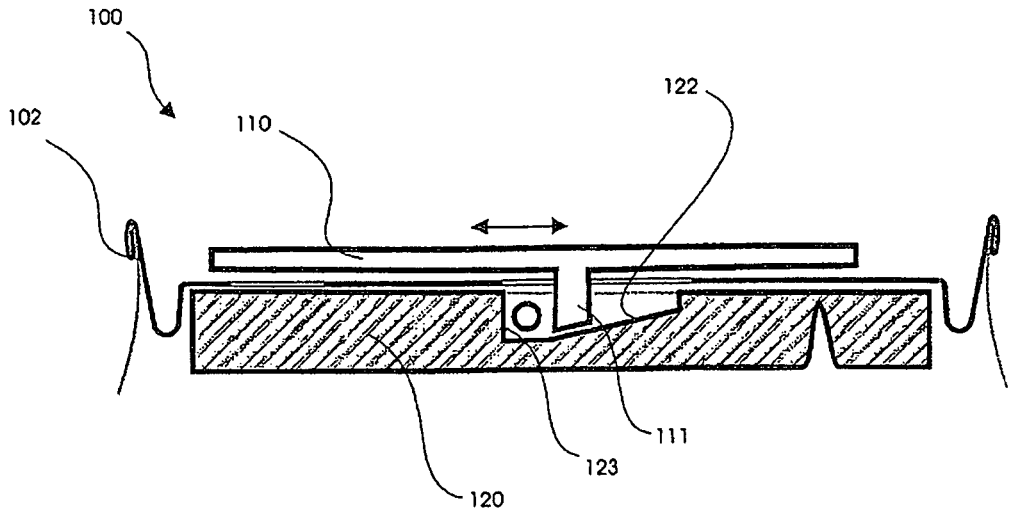

A closure element 120 is arranged beneath the surface 101 of the lid, which closure element seals the pouring opening 103 when the closure means 110 is in the closed position as shown in FIG. 1*a* and FIG. 1*c*. The closure element 120 comprises a receiver 121 for the operating element 111 of the actuating element 110, which receiver is arranged beneath the operating opening 104 and in which the operating element 111 is movable along a run-up slope 122.

When the closure means 110 is displaced in the direction of the arrow (FIG. 1*b*), a pressure equalizing opening 123 is exposed in the closure element 120 (FIGS. 1*d* and 1*e*) which in the closed position of the actuating element 110 is sealed in a gas-tight and fluid-tight manner by the operating element 111. The exposure of the pressure equalizing opening 123 leads to a pressure drop in the interior of the can. The closure element 110 additionally prevents any content of the can from spurting out.

Figure 1E:
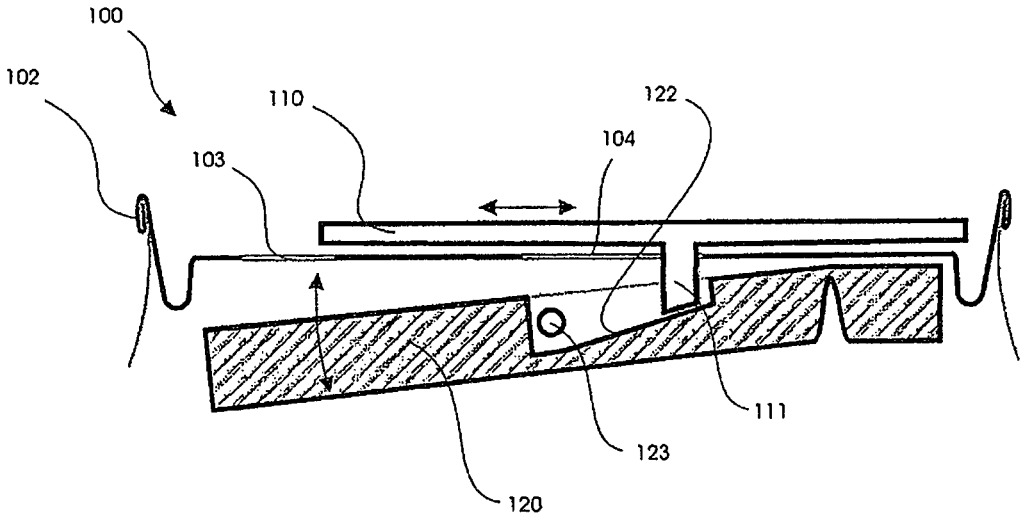

Only as a result of a further movement of the actuating element 110 will the closure element be pivoted in a substantially perpendicular way into the interior of the can by the displacement of the operating element 111 along the run-up slope 122, as a result of which the pouring opening 103 is exposed according to FIG. 1*e*.

In the embodiment of the invention as shown in FIGS. 1*a* to 1*e*, a closure is described with which the beverage can optionally be resealed again, with the operating element 111, which is preferably integrally arranged with the closure means 111, simultaneously acting as the closing element for the pressure equalizing opening 123. The embodiment as shown here merely comprises one pressure equalizing opening 123. It is also possible to provide several, e.g. two, pressure equalizing openings which are disposed opposite of one another in the receiver 121.

Figure 2:
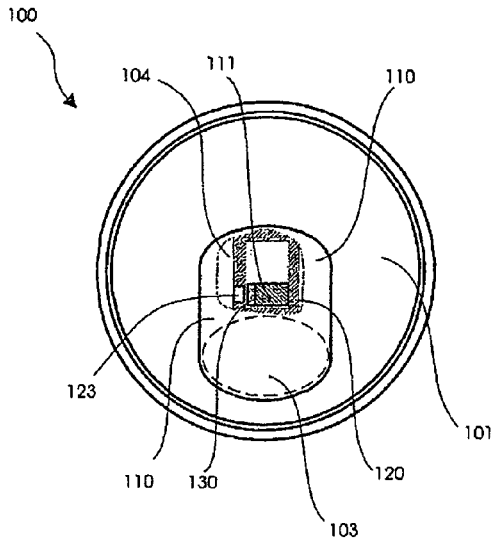
FIG. 2 shows a second embodiment of the invention.
Figure 3:
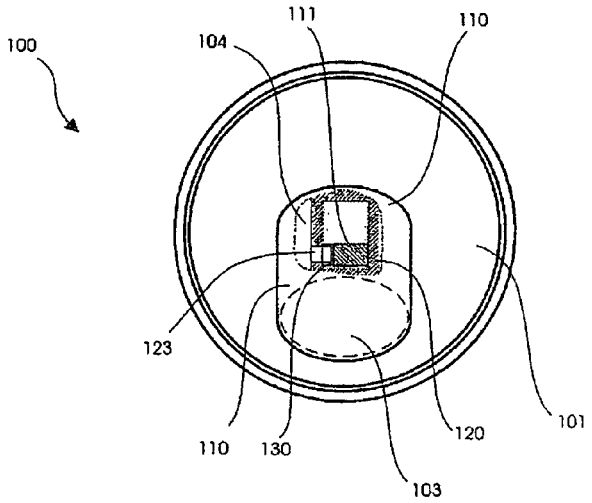
FIG. 3 shows a third embodiment of the invention.

Two further variants of the invention are shown in FIGS. 2 and 3. FIG. 2 shows a lid 100 with a closure device which is similar to the one in FIGS. 1*a* to 1*e*, with the operating element 111 additionally comprising an elastic seal 130 which seals the pressure equalizing opening 123 in an especially reliable way in the closed position of the actuating element 110.

In the embodiment as shown in FIG. 3, an elastic seal 130 is arranged annularly around the pressure equalizing opening 123 and seals the same against the ambient environment when the closure means 110 and therefore the operating element 111 is in the closed position, as is shown in this Fig.

Figure 4A:
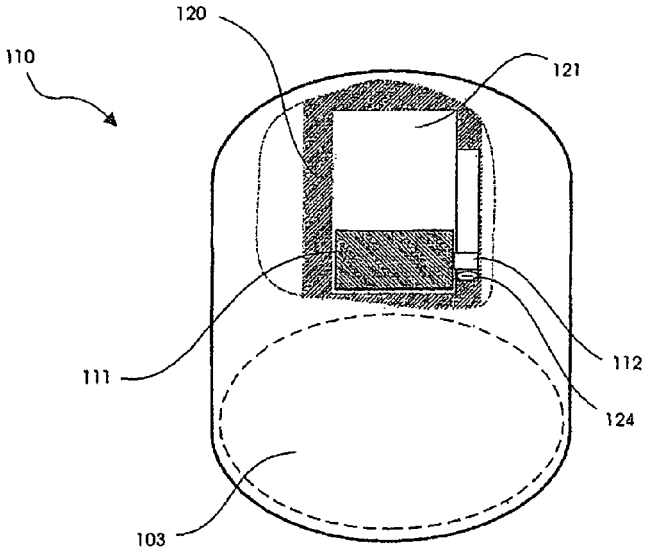
Figure 4B:
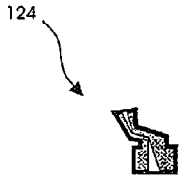
Figure 4C:
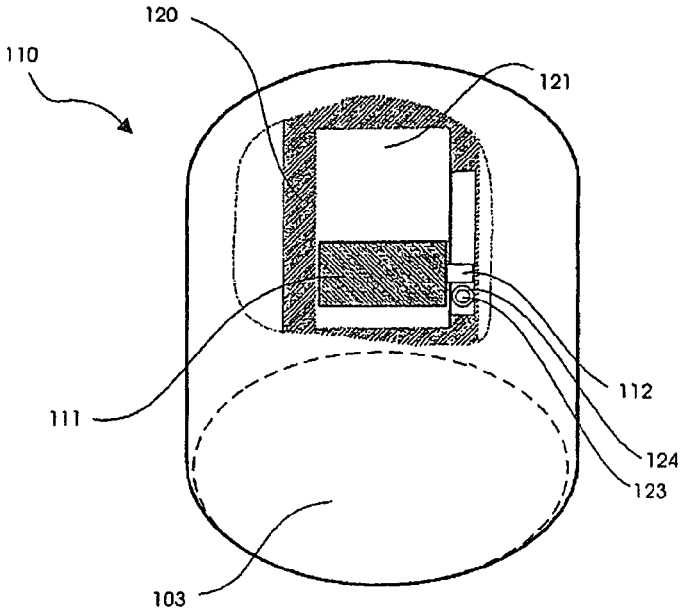
Figure 4D:
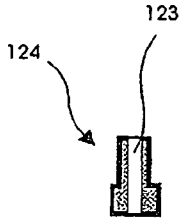
Figure 4E:
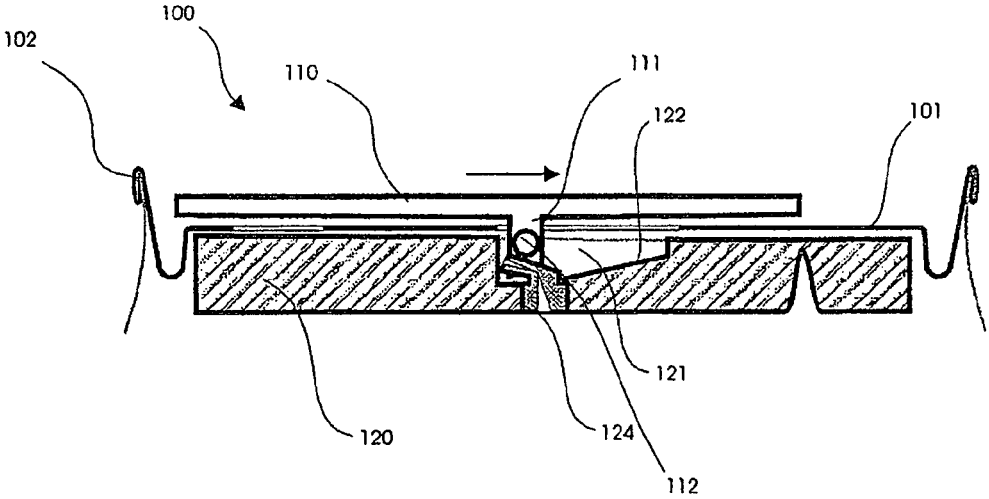
Figure 4F:
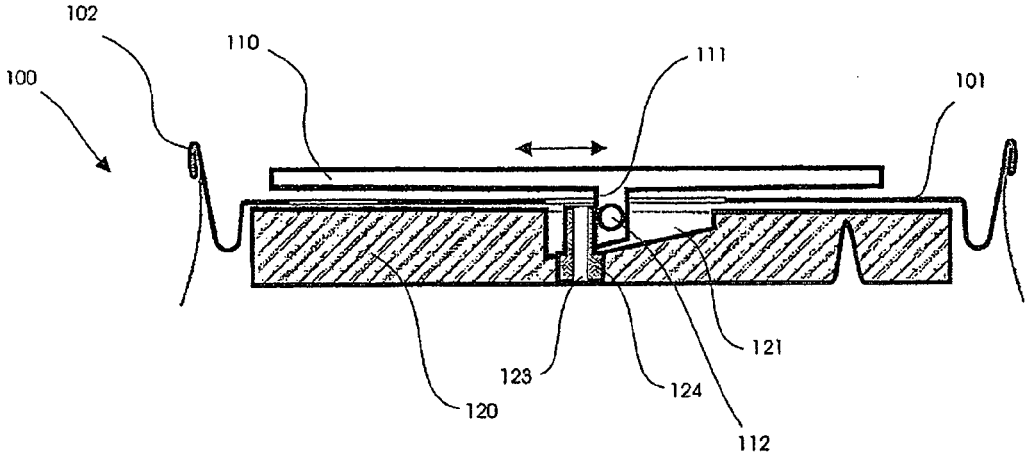
Figure 4G:
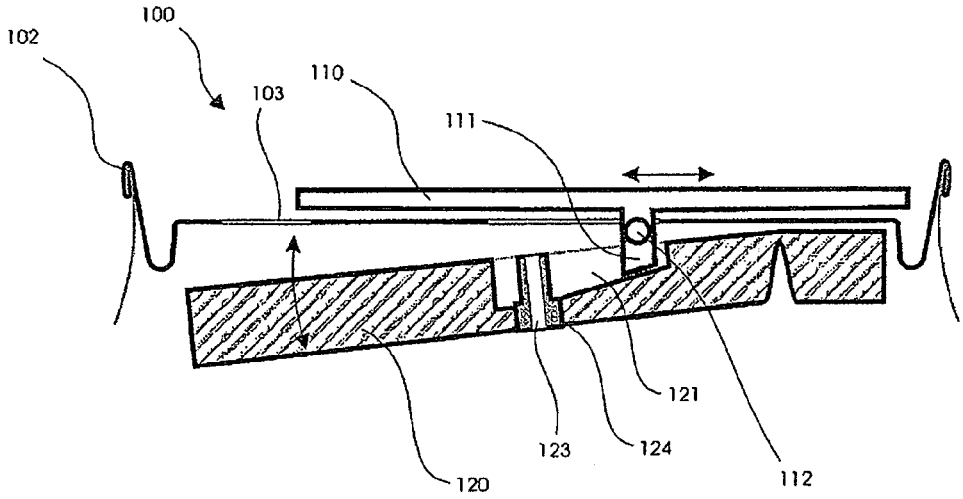

A further embodiment of the invention is shown in FIGS. 4*a* to 4*g*. A tube 124 is provided in the receiver 121, the interior of said tube acting as a pressure equalizing opening 123. If the closure means 110 is in the closed position (FIG. 4*a*, FIG. 4*e*), the tube 124 which is made of a flexible material is bent off by a pin 112 of the operating element 111 in such a way (FIG. 4*b*, FIG. 4*e*) that the cross section of the tube 124 is changed and thereby the connection of the pressure equalizing opening 123 with the ambient environment of the container is interrupted (FIG. 4*e*). This simple or even multiple bending produces a gas-tight and fluid-tight closure of the pressure equalizing opening 123.

The tube 124 is arranged in this embodiment on the run-up slope 122 of the closure element 120, with the bent tube 124 being released at first by the pin 112 of the operating element 111 by moving the actuating element 110 in the direction of the arrow in FIG. 4*e*, which tube will therefore straighten up as a result of its elastic properties, so that the pressure equalizing opening 123 is exposed (FIG. 4*f*) without thereby opening the pouring opening 103. This leads to pressure equalization of the pressurized beverage can with the ambient environment without the content of the can spurting out, because the closure means 110 will optionally act as a spurting protection means. The pouring opening 103 will be exposed by pivoting the closure element 120 after further movement of the actuating element 110 (FIG. 4*g*), with a lower force being required as a result of the previously occurring pressure equalization for exposing the pouring opening than if the container were still pressurized.

Figure 5A:
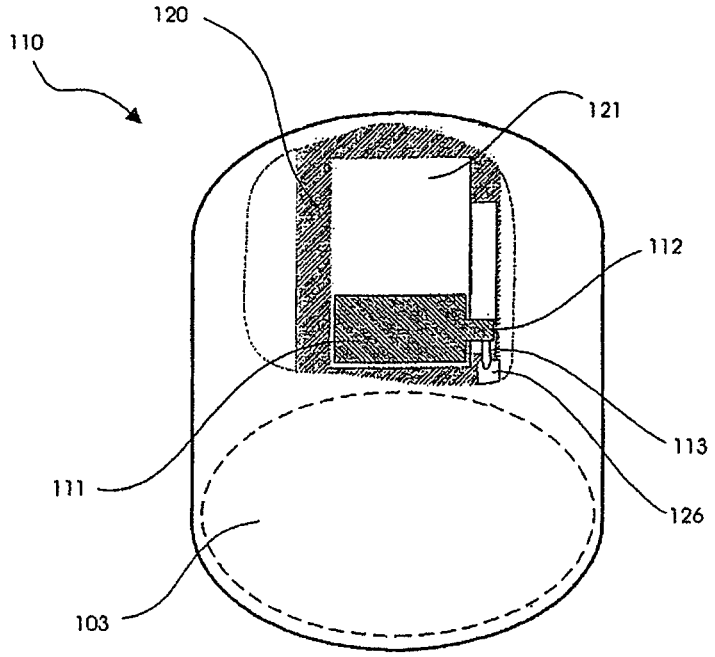
Figure 5B:
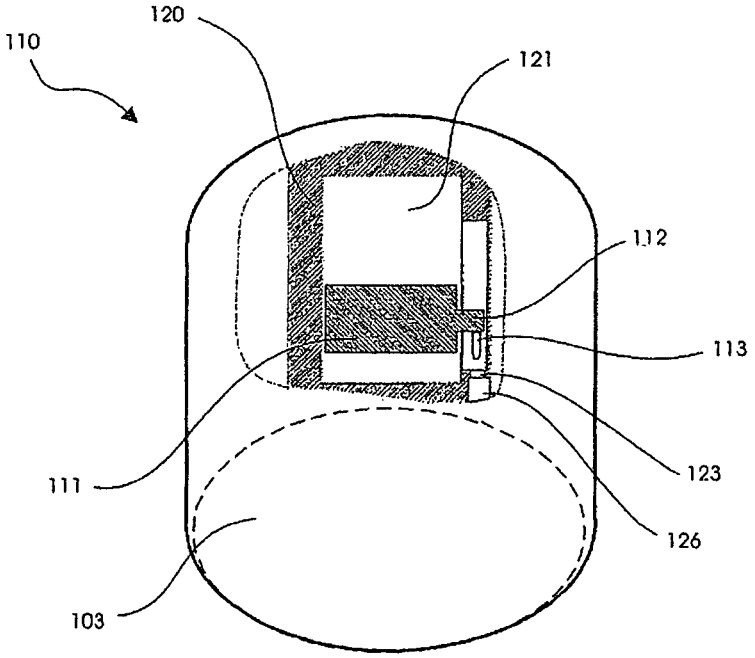
Figure 5C:
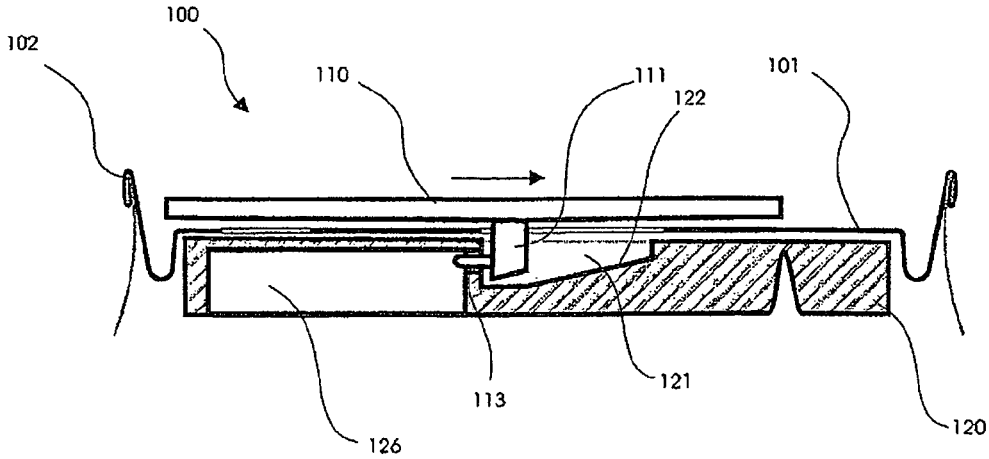
Figure 5D:
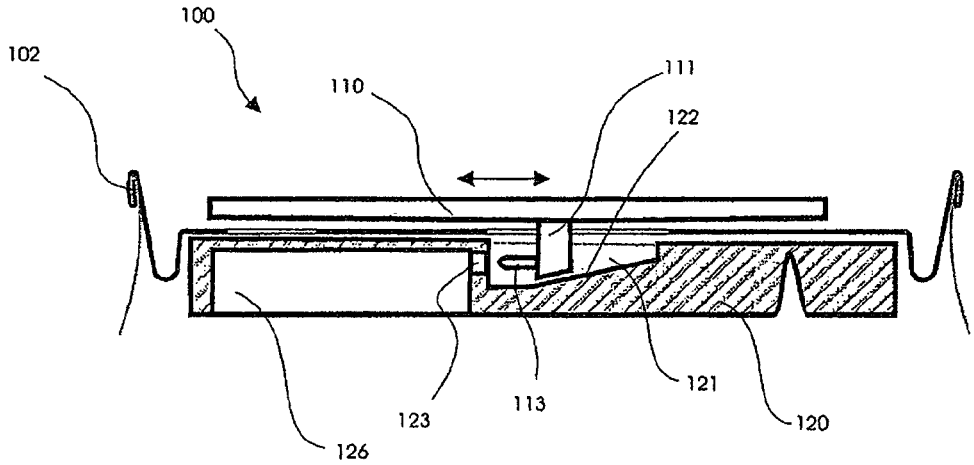
Figure 5E:
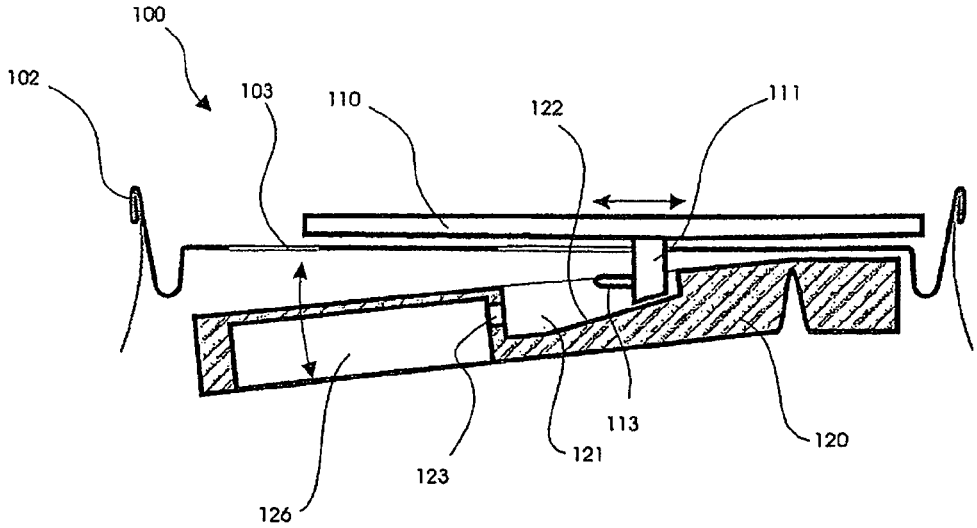

A further embodiment of the invention is shown in FIG. 5*a* to FIG. 5*e*. A plug 113 is provided which is arranged on a pin 112 of the operating element 111 and which engages in the pressure equalizing opening 123 when the container is sealed. When the actuating element 110 is moved in the direction of the arrow (FIG. 5*c*), the plug 113 is moved out of the pressure equalizing opening 123, so that the excess pressure which optionally prevails in the container is able to escape from the interior of the container to the outside via a recess 126 in the closure element 120 and the pressure equalizing opening 123 (FIG. 5*d*). When the actuating element 110 is moved further, the operating element 111 is guided along the run-up slope 122 of the receiver 121, so that the closure element 120 which is arranged beneath the lid surface 101 is pivoted into the interior of the container as a result of the exerted lever effect and the pouring opening 103 is exposed thereby (FIG. 5*e*).

When the container is resealed, the closure element 110 is moved to the closed position again, with the pretensioned closure means 120 resealing the pouring opening 103 and the plug 113 resealing the pressure equalizing opening 123. Preferably, suitable sealing means are provided in the regions around the pouring opening 103 and the pressure equalizing opening 123 which prevent the escape of the mostly fluid content of the container.

FIG. 6 shows a further preferred embodiment of the invention, in which the actuating means 110 is arranged as a slide which is arranged above the lid surface 101, whereas the actuating means 111 is movably embedded beneath the lid surface 101 in a recess 121 of the closure element 120, which recess faces the lid surface 101 in the assembled state of the lid 100. A pressure equalizing opening 123 is arranged in the side wall of the recess 121, which pressure equalizing opening is sealed by the operating element 111 in the closed position of the actuating element 110 (not shown).

FIG. 7 shows a further variant of the lid 100 of FIG. 6 in which the closure element 120 comprises a pressure equalizing opening 123 into which a pin 112 of the operating element 111 can be moved.

As an alternative thereto, FIG. 8 shows a sectional view of a variant in which a region 131 of the closure element 120 is elastically arranged, e.g. by a thinned material portion 127 and/or the use of different materials. When the actuating element 110 (FIG. 6) is actuated, the operating element 111 is also moved in the direction of the arrow. In this case, a stop 114 arranged on the operating element 111 slides along an inclined plane 128 in the surface of the closure element 120, so that there will be a lowering of the elastic region 131 as a result of the exerted lever effect and the thinned material portion 127. This lowering will lead to the consequence that a circumferential seal 132 which seals the closure element 120 against the lid surface 101 is deformed, thereby forming a pressure equalizing opening between the seal 132 and the lid 101 of the can, and pressure equalization can occur by them.

FIGS. 9 to 14 show an especially preferred embodiment of the lid 100 in accordance with the invention.

Figure 9:
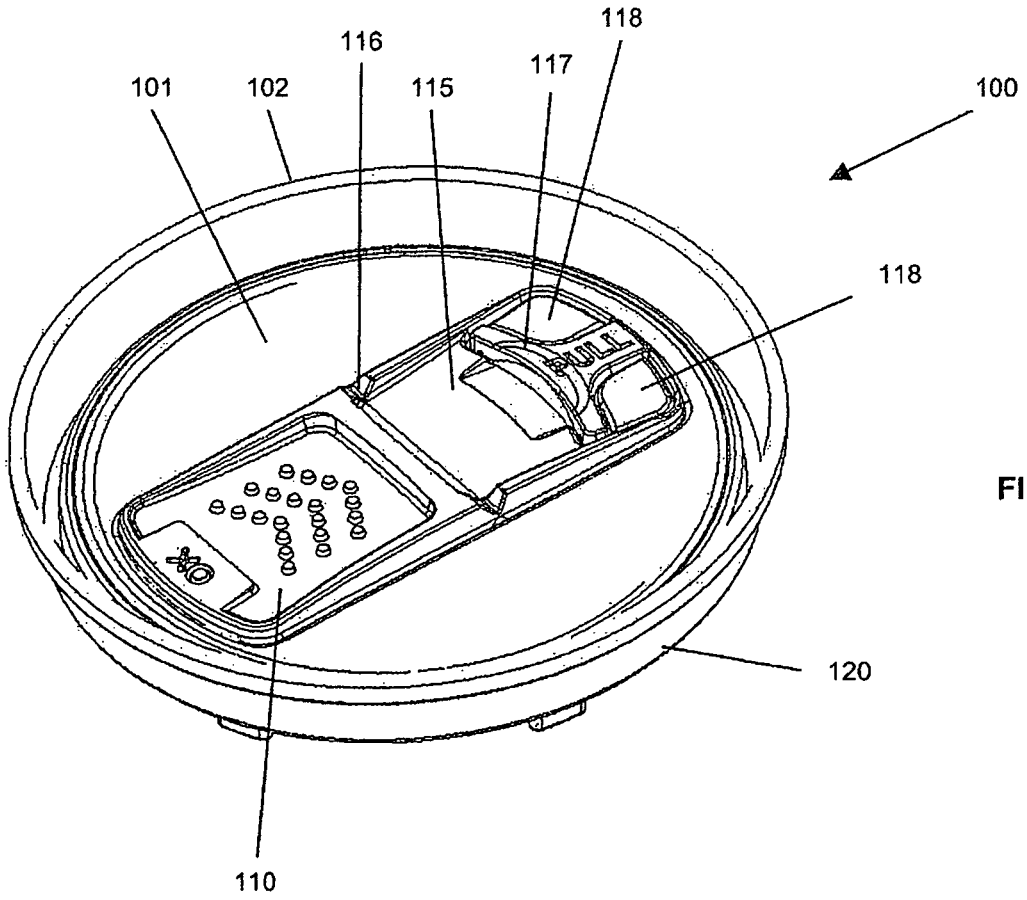

FIG. 9 shows the lid 100 in its closed state before its first opening, with the actuating element 110 being connected to a fixing element 115 by way of an articulated connection 116 such as a film hinge for example. The fixing element 115 comprises a handle 117 which is arranged in this variant of the invention in a substantially T-shaped manner.

Figure 10A:
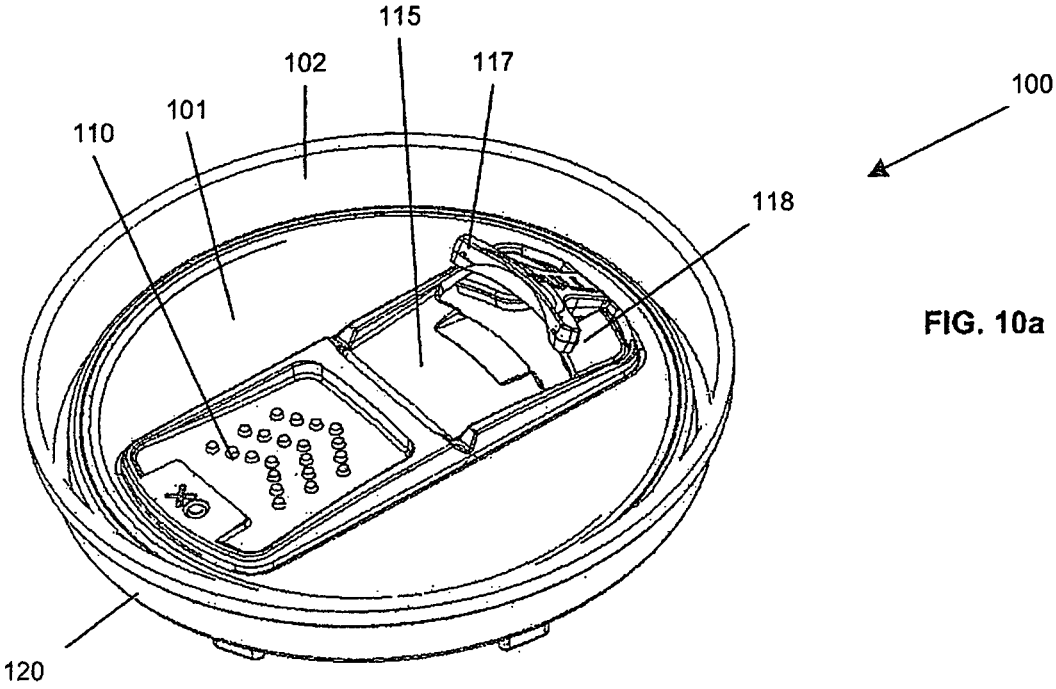
Figure 10B:
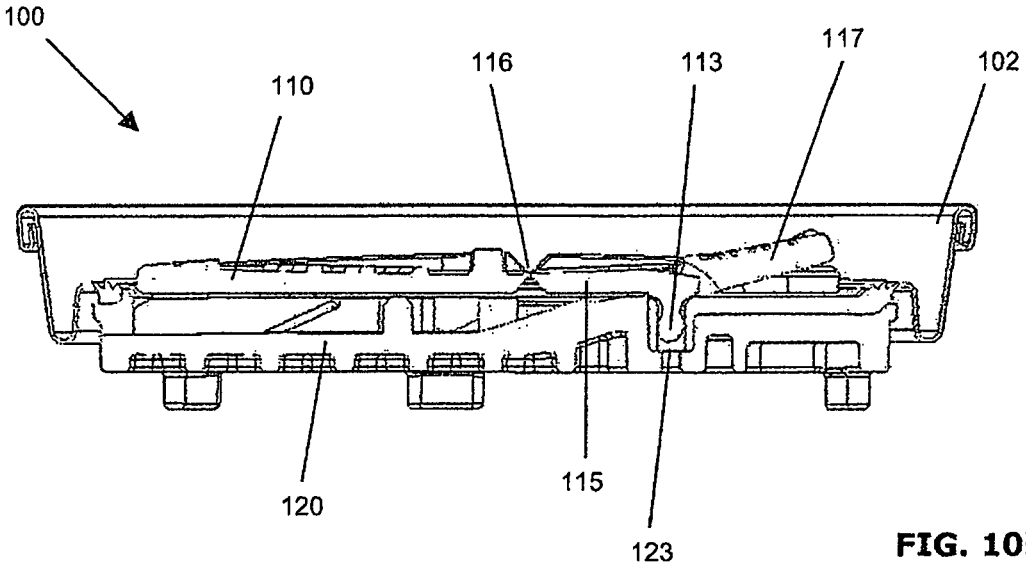

By lifting the handle 117 (FIG. 10*a*), it is severed from a connecting element 118 with which it was in connection by way of one or several predetermined breaking points. The primary function of the connecting element 118 is the fixing of the closure of the beverage can on the lid surface 101. The sectional view of FIG. 10*b* shows clearly that a pin 113 acting as a closing element is arranged in the pressure equalizing opening 123 of the closure element 120.

Figure 11A:
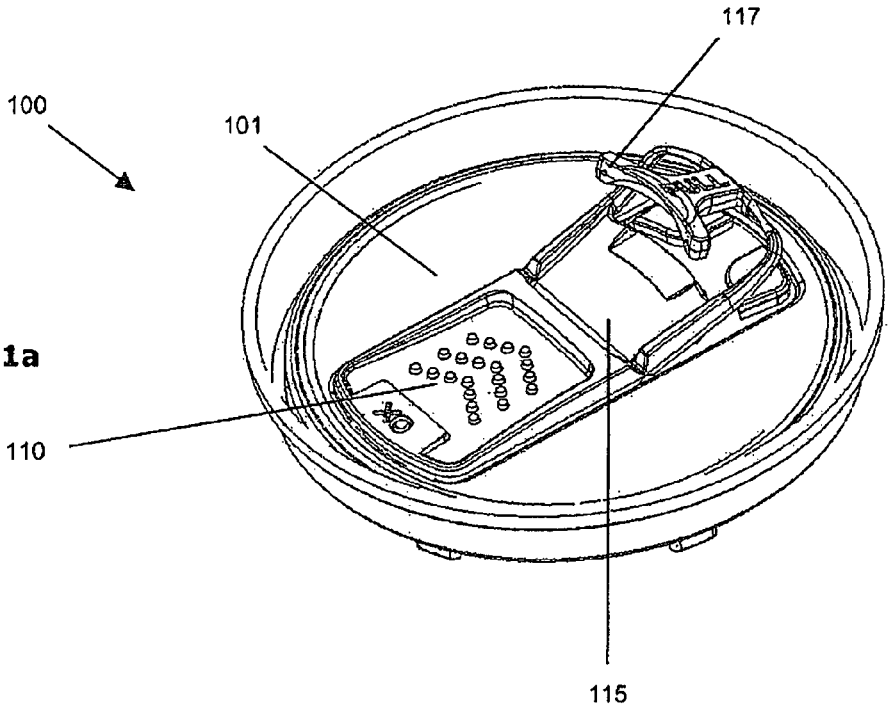
Figure 11B:
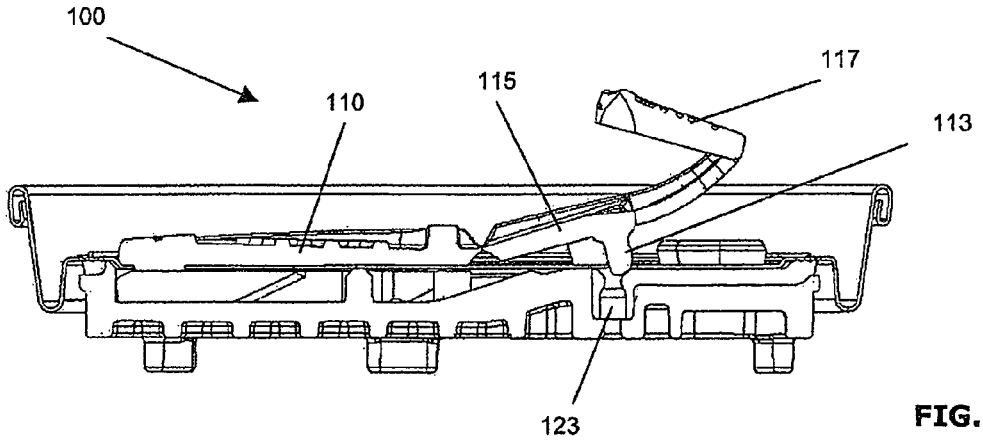
Figure 12A:
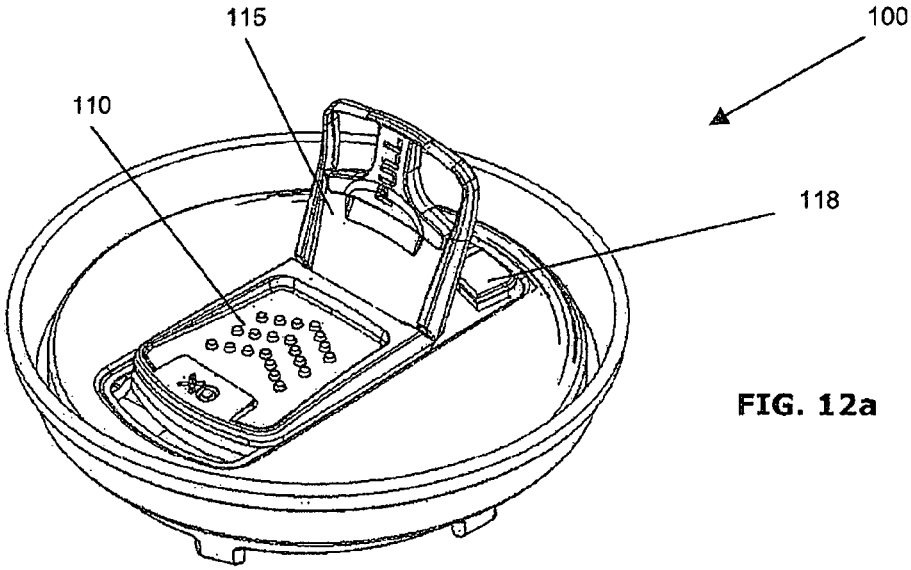
Figure 12B:
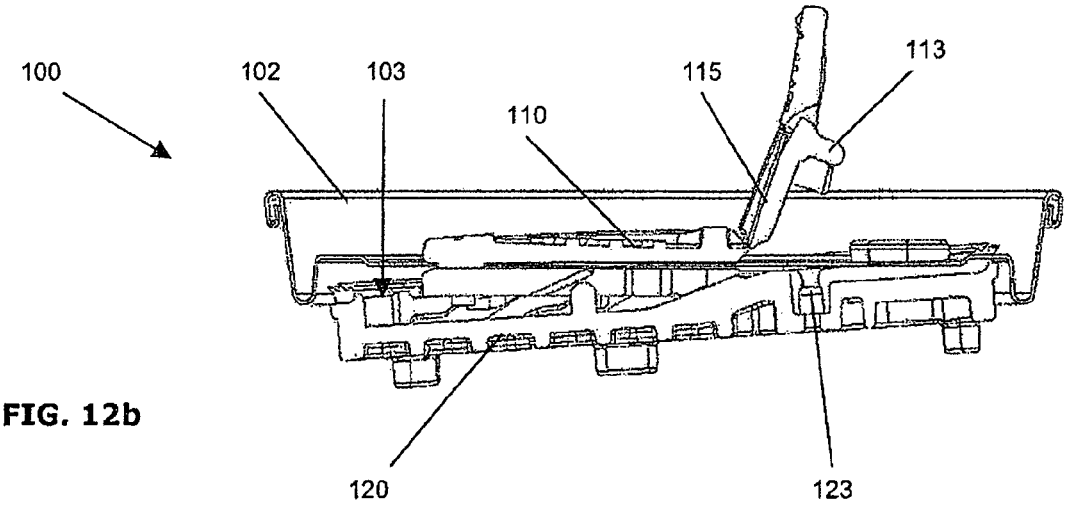
Figure 12C:
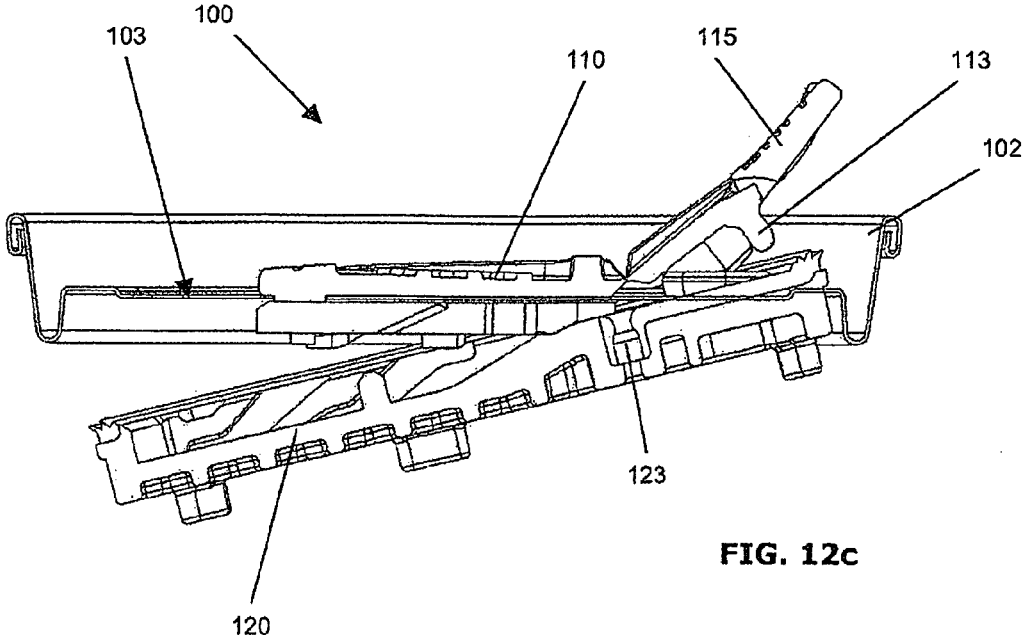
Figure 12D:
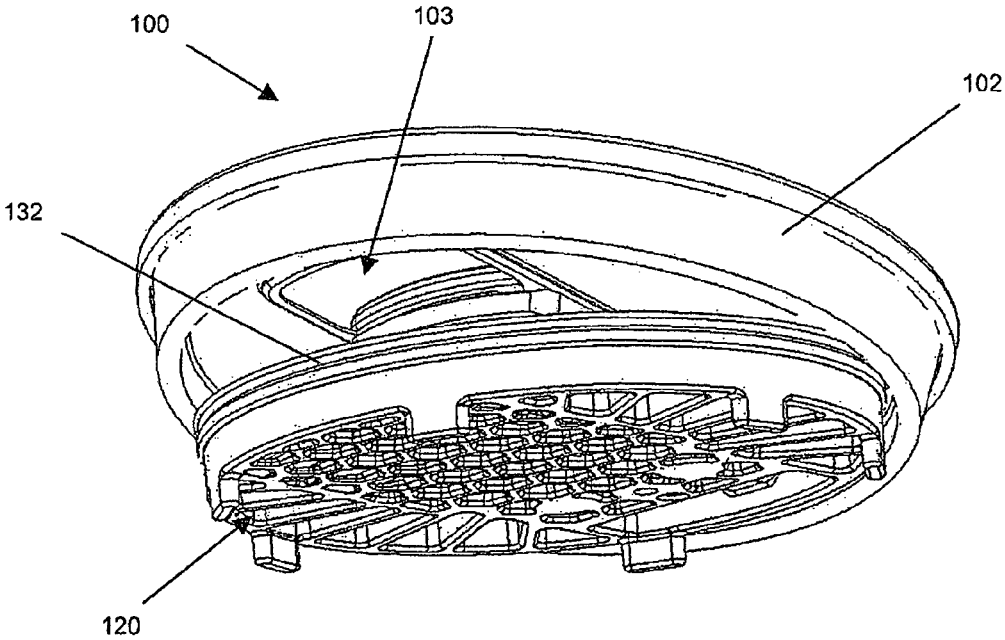

The fixing element 115 is lifted in a further step by a substantially pulling opening of the handle 117 and is severed entirely from the connecting element 118, wherein simultaneously the pin 113 is pulled out of the pressure equalizing opening 123 and pressure equalization can occur (FIG. 11*a* and FIG. 11*b*). The pulling movement will usually ensure that the handle 117 will be arranged again within a recess of the fixing element 115.

The actuating element 110 can now be displaced in the direction of the connecting element 118, by means of which the closure element 120 is pivoted into the interior of the can and the pouring opening 103 is exposed (FIG. 12*a* to FIG. 12*d*).

Figure 13A:
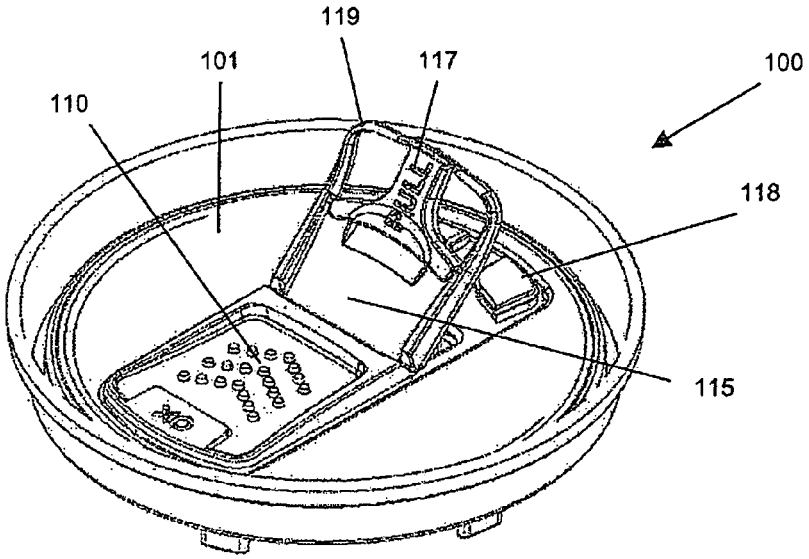
Figure 13B:
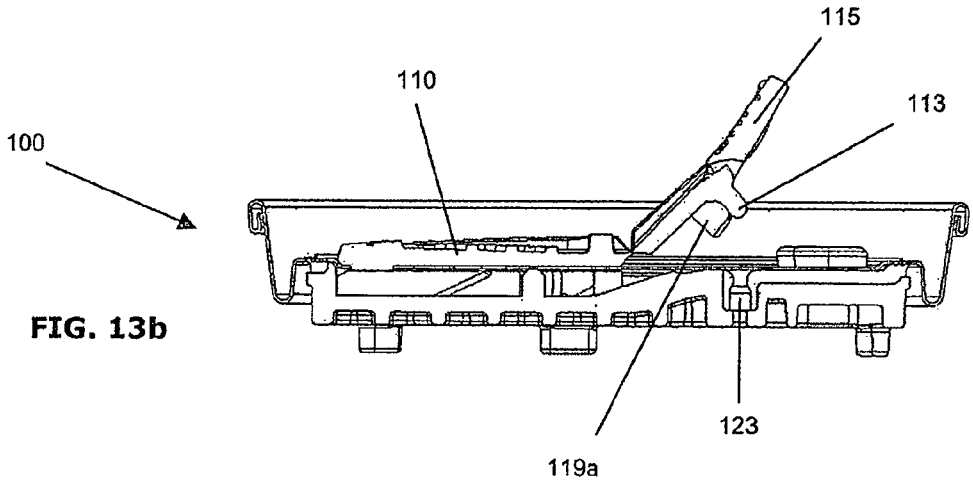
Figure 14:
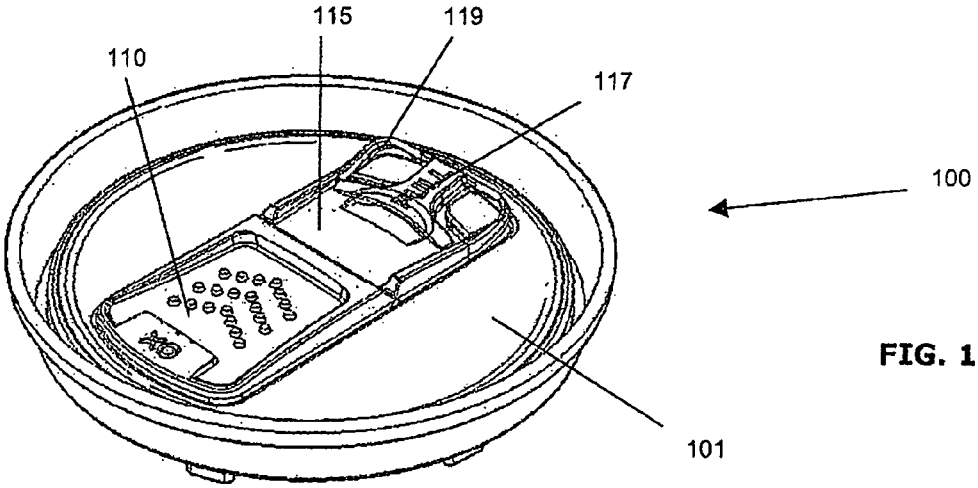

In order to reseal the can, the actuating element 110 is slid back to the original position again, thereby arranging the closure element 120 again parallel to the lid surface 101 and sealing the pouring opening 103 in a gas-tight and fluid-tight manner as a result of the circumferential seal 132 which also encloses the pressure equalizing opening 123 (FIG. 13*a* and FIG. 13 *b*).

Similarly, the pin 113 is arranged again in the pressure equalizing opening 123 by lowering of the fixing element 115 (FIG. 14), so that it is also sealed in a gas-tight and fluid-tight manner. Since the connecting portion 119 between the handle 117 and the fixing element 115 is intentionally made of a thin material, this connecting part 119 is extended during first actuation of the handle 117, especially when tearing open the predetermined breaking point, so that upon resealing the beverage can it is no longer obviously arranged in a precise manner around the connecting element 118. It can thereby be recognized immediately that the beverage can has already been opened.

In order to keep the fixing element 115 in the closed position without allowing it to be lifted inadvertently and thereby exposing the pressure equalizing opening 123, two latching pins 119*a* are provided which latch into respective recesses of the locking element 120 and permit pivoting of the fixing element 115 only with a certain application of force.

The embodiment of the invention as described above shall be regarded in a non-limiting way. Therefore the opening of the beverage can by means of a pulling motion on a handle can also occur from the edge of the can and not only from the central region of the surface of the lid as described in the ninth embodiment of the invention. It can especially also be provided that the actuating element is not arranged as a sliding element, but that the opening of the container occurs by means of twisting of the actuating element. In this case, the pressure equalization occurs by way of a pressure equalizing opening in a helix element for example which, acting as an operating element, interacts with an actuating element in connection with the closure means in order to open the container.

The invention claimed is:

1. A lid of a container comprising a substantially flat lid surface and a folded edge area, and at least one pouring opening arranged on the lid surface, which pouring opening can be closed in a gas-tight and/or fluid-tight manner by way of at least one closure element arranged in the region of an underside of the lid surface facing an interior of the container, with the closure element being movable from a closed position to an open position by an actuating element, and including at least one pressure equalizing device which cooperates with the at least one actuating element, wherein the at least one pressure equalizing device comprises at least one closing element, and including at least one pressure equalizing opening which is closeable by means of the at least one closing element when the actuating element is in the closed position and can be exposed entirely upon moving the actuating element from the closed position to the open position, with exposure of the pressure equalizing opening being reversible, wherein the at least one actuating element is twistable relative to the lid surface, wherein the actuating element is twistable along a helix element, with the at least one pressure equalizing opening being arranged in the helix element.

2. A lid of a container comprising a substantially flat lid surface and a folded edge area, and at least one pouring opening arranged on the lid surface, which pouring opening can be closed in a gas-tight and/or fluid-tight manner by way of at least one closure element arranged in the region of an underside of the lid surface facing an interior of the container, with the closure element being movable from a closed position to an open position by an actuating element, and including at least one pressure equalizing device which cooperates with the at least one actuating element, wherein the at least one pressure equalizing device comprises at least one closing element, and including at least one pressure equalizing opening which is closeable by means of the at least one closing element when the actuating element is in the closed position and can be exposed entirely upon moving the actuating element from the closed position to the open position, with exposure of the pressure equalizing opening being reversible, wherein the fixing of the actuating element occurs by way of a fixing element with a handle which is swivellable from a plane arranged substantially parallel to the lid surface, with the fixing element being connected in an articulated and non-detachable way with the actuating element, wherein prior to the first pivoting for exposing the actuating element, the handle is in connection by way of at least one predetermined breaking point with at least one connecting element arranged on the lid surface.

3. The lid according to claim 2, wherein the closing element for the pressure equalizing opening is arranged on the fixing element.

4. A lid of a container comprising a substantially flat lid surface and a folded edge area, and at least one pouring opening arranged on the lid surface, which pouring opening can be closed in a gas-tight and/or fluid-tight manner by way of at least one closure element arranged in the region of an underside of the lid surface facing an interior of the container, with the closure element being movable from a closed position to an open position by an actuating element, and including at least one pressure equalizing device which cooperates with the at least one actuating element, wherein the at least one pressure equalizing device comprises at least one closing element, and including at least one pressure equalizing opening which is closeable by means of the at least one closing element when the actuating element is in the closed position and can be exposed entirely upon moving the actuating element from the closed position to the open position, with exposure of the pressure equalizing opening being reversible, wherein the fixing of the actuating element occurs by way of a fixing element with a handle which is swivellable from a plane arranged substantially parallel to the lid surface, with the fixing element being connected in an articulated and non-detachable way with the actuating element, wherein the handle is arranged in a Y-shaped or T-shaped manner.

* * * * *